US005876635A

United States Patent [19]

Jeong et al.

[11] Patent Number: 5,876,635

[45] Date of Patent: Mar. 2, 1999

[54] CONDUCTIVE COMPOSITION

[75] Inventors: Bong-mo Jeong, Seoul; Min-ho Kim, Suwon; Jae-ho Shim, Seoul; Wan-woo Park, Yongin; Deuk-yong Yang, Suwon, all of Rep. of Korea

[73] Assignee: Samsung Display Devices Co., Ltd., Kyungki-Do, Rep. of Korea

[21] Appl. No.: 777,326

[22] Filed: Dec. 27, 1996

[30] Foreign Application Priority Data

Dec. 29, 1995 [KR] Rep. of Korea ..... 95-66815

[51] Int. Cl.[6] ..... H01B 1/20

[52] U.S. Cl. ..... 252/520.1; 252/519.3

[58] Field of Search ..... 252/520.1, 519.3, 252/519.33; 423/618

[56] References Cited

U.S. PATENT DOCUMENTS 4,113,507 9/1978 McHenry et al. ..... 106/287.18
5,204,177 4/1993 Sato et al. ..... 428/328
5,340,676 8/1994 Anderson et al. ..... 430/63

FOREIGN PATENT DOCUMENTS 0120581 10/1984 European Pat. Off. .
0616261 9/1994 European Pat. Off. .

OTHER PUBLICATIONS

*Grant & Hackh's Chemical Dictionary,* Stm Ed., 1988.

*Primary Examiner*—Mark Kopec
*Attorney, Agent, or Firm*—Leydig, Voit & Mayer

[57] ABSTRACT

A conductive composition and a CRT bulb employing the conductive layer. The conductive composition includes from about 0.4 to about 10 wt % of tin oxide, from about 4.5 to about 7.0 wt % of a dispersing agent, from about 3.5 to about 7.0 wt % of an antiabsorbent, from about 0.8 to about 4.0 wt % of a vaporization inhibitor, and from about 0.020 to about 0.25 wt % of a surfactant, based on the total weight of an alcoholic solvent. The conductive composition exhibits good solubility, coating performance, and heat stability, and a conductive layer formed of the conductive composition exhibits low surface resistance and enhanced luminance.

1 Claim, No Drawings

CONDUCTIVE COMPOSITION

BACKGROUND OF THE INVENTION

The present invention relates to a conductive composition and a bulb for a cathode ray tube (CRT) employing a conductive layer formed of the same, and more particularly, to a conductive composition exhibiting good coating performance and solubility and capable of forming a conductive layer exhibiting enhanced luminance due to little residue left after a sintering process, and a CRT bulb employing a conductive layer formed of the same.

Conductive compositions have been used in various fields applying electrophotographic techniques, such as photocopiers and laser printers, and especially for the phosphor screen of a color cathode ray tube. Here, the phosphor screen used for a color cathode ray tube can be manufactured by a slurry coating method (hereinafter, referred to slurry method) or an electrophotographic process.

In the slurry method, the panel is cleaned and then three phosphor slurries (corresponding to the primary colors, i.e., green, blue and red) are respectively applied to on the panel. Each phosphor slurry contains polyvinylalcohol (as a main component), ammonium dichromate, and one of green-, blue-, and red-emitting phosphors.

In more detail, the first (e.g., green) phosphor slurry is applied to on the inner surface of the panel. The resultant panel is exposed to ultraviolet light and developed, to form a phosphor pattern (dotted or striped) which is then dried to yield the green portion of a final pattern. The same procedure is applied for the blue-emitting phosphor slurry and the red-emitting phosphor slurry, in turn, to thereby complete the phosphor pattern.

The slurry method, however, has some serious problems. First, the phosphors are not completely developed and thus remain at an exposed portion in a relatively large amount so that the remaining phosphor is mixed with the phosphor applied later. Second, a reaction between the polyvinylalcohol and ammonium dichromate contained in the slurry produces a coloring substance, which deteriorates color purity.

On the other hand, another method for manufacturing the phosphor screen of the color cathode ray tube using an electrophotographic technique is not only simpler than the slurry method, but can also provide a color cathode ray tube having better luminance properties. In this method, first, the panel is treated with chemicals and a surfactant, rinsed with distilled water and then dried. Thereafter, a conductive layer is formed on the inner side of the panel by a spin-coating method or spraying method, and a photoconductive layer is then formed thereon. The photoconductive layer is electrified with a corona electrifier and a predetermined portion thereof is exposed through a shadow mask. Finally, the exposed portion of the photoconductive layer is controlled to be in an electrically neutral state, and green-, blue- and red-emitting phosphor compositions are respectively adhered to the unexposed portion thereof, to form a phosphor screen.

In the case of an electrophotographic photocopier, since aluminum cylinder is a conductor, a photoconductive material can be directly applied to the aluminum cylinder for use as a photoconductor. Meanwhile, in the case of a color cathode ray tube of which the front panel is made of insulating material, e.g., glass, the conductive layer should be formed prior to forming a photoconductive layer because the photoconductive material cannot be directly applied to the CRT's glass panel.

However, since a conventional conductive composition such as polybrene-propanol exhibits poor solubility and coating performance, and the conductive layer formed of the conventional conductive composition has a high surface resistance of $10^9$~$10^{11}\Omega/\square$. Furthermore, the conventional conductive composition has a poor pyrolysis property and thus generates a large amount of residue during a sintering process. The residue should be removed in order to increase luminance.

Owing to the above-described physical and chemical limitations, the conventional composition is not suitable for the electrophotographic technique.

SUMMARY OF THE INVENTION

To solve such problems, it is an object of the present invention to provide a conductive composition for use in forming a color cathode ray tube by an electrophotographic technique, exhibiting good solubility and coating performance and being able to form a conductive layer which has a low surface resistance and can be dried in a short time at room temperature.

To achieve the above object of the present invention, there is provided a conductive layer composition comprising from about 0.4 to about 10 wt % of tin oxide ($SnO_2$), from about 4.5 to about 7.0 wt % of a dispersing agent, from about 3.5 to about 7.0 wt % of an antiabsorbent, from about 0.8 to about 4.0 wt % of a vaporization inhibitor, and from about 0.020 to about 0.25 wt % of surfactant, based on the total weight of an alcoholic solvent.

It is another object of the present invention to provide a bulb for a cathode ray tube having a conductive layer formed of the conductive composition of the present invention.

To achieve the object of the present invention, there is provided a bulb for a cathode ray tube, having a face plate on which a conductive layer, a photoconductive layer and a phosphor screen are sequentially formed, a funnel connected to said face plate and provided with an electron gun and a deflection yoke, wherein the conductive layer is formed of a conductive composition comprising from about 0.4 to about 10 wt % of tin oxide ($SnO_2$), from about 4.5 to about 7.0 wt % of a dispersing agent, from about 3.5 to about 7.0 wt % of an antiabsorbent, from about 0.8 to about 4.0 wt % of a vaporization inhibitor, and from about 0.020 to about 0.25 wt % of a surfactant, based on the total weight of an alcoholic solvent.

DETAILED DESCRIPTION OF THE INVENTION

A conductive composition according to the present invention comprises from about 0.4 to about 10 wt % of a tin oxide ($SnO_2$), from about 4.5 to about 7.0 wt % of dispersing agent, from about 3.5 to about 7.0 wt % of an antiabsorbent, from about 0.8 to about 4.0 wt % of a vaporization inhibitor, and from about 0.020 to about 0.25 wt % of a surfactant, based on the total weight of an alcoholic solvent.

According to the present invention, the alcoholic solvent includes methanol, ethanol, and mixtures thereof.

As the dispersing agent for uniformly dispersing tin oxide into the alcoholic solvent, t-butanol or t-amylalcohol is used.

The antiabsorbent diminishes the hygroscopic property of the conductive layer to thereby prevent generation of static electricity. As the antiabsorbent, methylcellosolve or 2-ethoxyethanol is used.

The vaporization inhibitor prevents deterioration of coating appearance caused by rapid vaporization of the solvent.

Such a vaporization inhibitor is selected from the group consisting of dimethylformamide and dioctylphthalate.

Furthermore, a surfactant can be added to reduce the surface tension of the conductive composition thereby enhancing a wetting property of the conductive layer. As the surfactant, non-ionic surfactants such as TRITON-CF54, a liquid detergent, (manufactured by Sigma Chemical company of St. Louis, Mo.) is used.

A bulb for a cathode ray tube in accordance with the present invention comprises a face plate on which a conductive layer, a photoconductive layer and a phosphor screen are sequentially formed, a funnel connected to the face plate and provided with an electron gun and a deflection yoke, wherein the conductive layer is formed of a conductive composition comprising from about 0.4 to about 10 wt % of tin oxide ($SnO_2$), from about 4.5 to about 7.0 wt % of a dispersing agent, from about 3.5 to about 7.0 wt % of an antiabsorbent, from about 0.8 to about 4.0 wt % of a vaporization inhibitor, and from about 0.020 to about 0.25 wt % of surfactant, based on the total weight of a an alcoholic solvent.

When compared with the conventional conductive composition comprising an organic conductive polymer such as polybrene, the conductive composition of the present invention exhibits good coating performance and solubility and leaves a little residue during the sintering process. Therefore, the conductive layer has a low surface resistance ($10^7$~$10^8\Omega/\square$) and good thermal stability.

The composition of the present invention can be dried at room temperature (i.e., without any special drying means) because the alcohol used as a solvent is highly volatile.

The conductive composition of the present invention can be used in the various fields applying electrophotographic techniques, especially, in manufacturing the phosphor screen of a color cathode ray tube.

Now, the method for manufacturing a phosphor screen of a color cathode ray tube applying an electrophotographic technique will be explained in detail as an example of using the conductive composition of the present invention.

First, the panel is subjected to the cleaning treatment, rinsed with distilled water, and then dried. The conductive composition of the present invention comprising from about 0.4 to about 10 wt % of tin oxide ($SnO_2$), from about 4.5 to about 7.0 wt % of a dispersing agent, from about 3.5 to about 7.0 wt % of an antiabsorbent, from about 0.8 to about 4.0 wt % of vaporization inhibitor, and from about 0.020 to about 0.25 wt % of a surfactant, based on the total weight of an alcoholic solvent is applied to the inner surface of the panel by spin-coating or spraying, to form a conductive layer having a thickness of from about 0.5 to about 1.0 $\mu$m. A photoconductive composition is applied to the conductive layer to form a photoconductive layer. The photoconductive layer is electrified with a corona electrifier and a predetermined regions thereof are exposed through a shadow mask. The exposed portion of the photoconductive layer is controlled to be in an electrically neutral state, and green-, blue- and red-emitting phosphor compositions are adhered to the unexposed portion thereof, respectively. The phosphors are semi-solidified using a strongly volatile solvent such as methanol, ethanol, and mixture thereof. Then, the phosphor composition is completely fused on the resulting panel of the color cathode ray tube by means of an infrared heater, to thereby form a phosphor screen.

Here, the thickness of the conductive layer is 0.5–1.0 $\mu$m. When the thickness is less than 0.5 $\mu$m, the conductivity of the layer is decreased. On the other hand, when the thickness is more than 1.0 $\mu$m, the stability and transparency of the layer is deteriorated.

Hereinbelow, the preparation process will be explained with the following example; however, the invention is not limited to this example.

EXAMPLE

A conductive composition according to the present invention was prepared as follows:

| | |
|---|---|
| methanol | 60 g |
| ethanol | 24 g |
| t-butanol | 5 g |
| methylcellosolve | 4 g |
| dimethylformamide | 2 g |
| tin oxide | 4.22 g |
| surfactant (CF-54) | 0.19 g |
| | 100 g |

The prepared conductive composition was applied to the inner surface of the glass panel of a color cathode ray tube, to form a conductive layer. The thickness thereof was 1 $\mu$m.

After drying the conductive layer, the surface resistance thereof was measured. The conductive layer had a surface resistance of $10^8\Omega/\square$.

The amount of residue left after a sintering process is decreased when compared with the conventional composition, which leads to an increase of luminance.

As described above, the conductive composition of the present invention, which is useful for a conductive layer in manufacturing a color cathode ray tube using an electrophotographic technique, exhibits good coating properties, solubility, and thermal stability, and can be rapidly dried at room temperature. Further, a conductive layer formed of the conductive composition of the present invention has a low surface resistance and enhanced luminance due to a reduction of the residue left after a sintering process in manufacturing a color cathode ray tube.

What is claimed is:

1. A conductive composition comprising an alcoholic solvent selected from the group consisting of methanol, ethanol, and mixtures thereof, from about 0.4 to about 10 wt % of tin oxide, from about 4.5 to about 7.0 wt % of a dispersing agent for dispersing the tin oxide in said alcoholic solvent and selected from the group consisting of t-butanol and t-amylalcohol, from about 3.5 to about 7.0 wt % of an antiabsorbent for diminishing water absorption by said conductive composition and selected from the group consisting of methylcellosolve and 2-ethoxyethanol, from about 0.8 to about 4.0 wt % of a solvent vaporization inhibitor for inhibiting vaporization of said alcoholic solvent and selected from the group consisting of dimethylformamide and dioctylphthalate, and from about 0.020 to about 0.25 wt % of a surfactant for reducing surface tension of said conductive composition, based on the total weight of said alcoholic solvent.

* * * * *